United States Patent [19]

Strickland et al.

[11] Patent Number: 4,720,247

[45] Date of Patent: Jan. 19, 1988

[54] OIL WELL PUMP

[75] Inventors: Albert L. Strickland; William O'Dell, both of Spring, Tex.

[73] Assignee: Landell International Company, Inc., Houston, Tex.

[21] Appl. No.: 930,272

[22] Filed: Nov. 14, 1986

[51] Int. Cl.[4] ..... F04B 17/00

[52] U.S. Cl. ..... 417/392

[58] Field of Search ..... 417/392, 383, 378

[56] References Cited

U.S. PATENT DOCUMENTS

| | | | |
|---|---|---|---|
| 1,946,723 | 2/1934 | Thompson | 417/378 |
| 2,248,302 | 7/1941 | McKay | 417/392 X |
| 2,277,306 | 3/1942 | Coffey | 417/383 |
| 2,562,584 | 7/1951 | Soberg | 417/392 |
| 4,013,385 | 3/1977 | Peterson | 417/378 X |
| 4,297,088 | 10/1981 | Akkerman | 417/378 |
| 4,490,095 | 12/1984 | Soderberg | 417/392 |

*Primary Examiner*—Leonard E. Smith
*Attorney, Agent, or Firm*—Solon B. Kemon

[57] ABSTRACT

A oil well reciprocating piston pump is fluid pressure operated from a source at the earth's surface. The piston is hollow and serves also as a sealed cylinder for a free piston which is gas biased downwardly. The underside of the free piston is in contact with a body of oil displaceable from the sealed cylinder into the annular space between the hollow piston and its cylinder to bias the hollow piston toward the bottom of its stroke.

2 Claims, 3 Drawing Figures

OIL WELL PUMP

BACKGROUND OF THE INVENTION

Oil well pumps operated by fluid pressure sources located at the earth's surface are known and examples may be found in U.S. Pat. Nos. 2,338,903 and 4,490,095 by way of example. As is well known in this art, the problems of operating pumps in the hostile environment of oil wells are many. The fluids encountered are corrosive in addition to being highly abrasive and consequently it is desirable to have pumps with as few working parts as possible and ones which expose as few working parts to as little of the hostile environment as possible. Replacement or repair of such pumps is both time consuming and expensive because it involves removing the pump from great depth to the earth's surface.

BRIEF DESCRIPTION OF THE INVENTION

The pump of the present invention is of the reciprocating piston type with intake and discharge valves in the cylinder head and a connection at the opposite end for admission of high pressure working fluid to cause elevation of the piston. The piston itself is hollow and closed at opposite ends by heads which are slidably sealingly engaged with the interior of the cylinder wall leaving an annular space between the outer wall of the hollow piston and the inner wall of the cylinder. At a position on the cylinder wall corresponding to substantially the mid stroke of the piston, the cylinder includes a fixed inwardly extending collar which is slidably sealingly engaged, at its opposite ends with the outer surface of the hollow piston. Within the hollow piston there is a free piston which is normally biased downwardly by a pressurized gas within the hollow piston. At its lower end, the hollow piston is ported to the annular space between it and its cylinder and the volume represented by the annular space and the interior of the hollow piston below the free piston is filled with an incompressible fluid such as a hydraulic oil. In the absence of the application of high pressure working fluid to the under surface of the hollow piston, the pressure of the gas above the free piston forces the incompressible fluid through the ports into the annular space and biases the entire piston assembly toward the bottom of its cylinder. This then effects automatic return of the piston assembly from the top of its pumping stroke to its lowermost position. During downstroke of the piston assembly, pressure in the upper portion of the cylinder is lowered and well fluid enters through the intake valve. Application of working fluid to the underside of the piston assembly forces the entire assembly upward to discharge the well fluid through the discharge valve and at the same time forces the fluid in the annular space between the piston and cylinder into the hollow piston which causes the free piston to rise and raise the pressure of the gas in the space above the free piston.

DETAILED DESCRIPTION OF THE DRAWING

Figure 1:
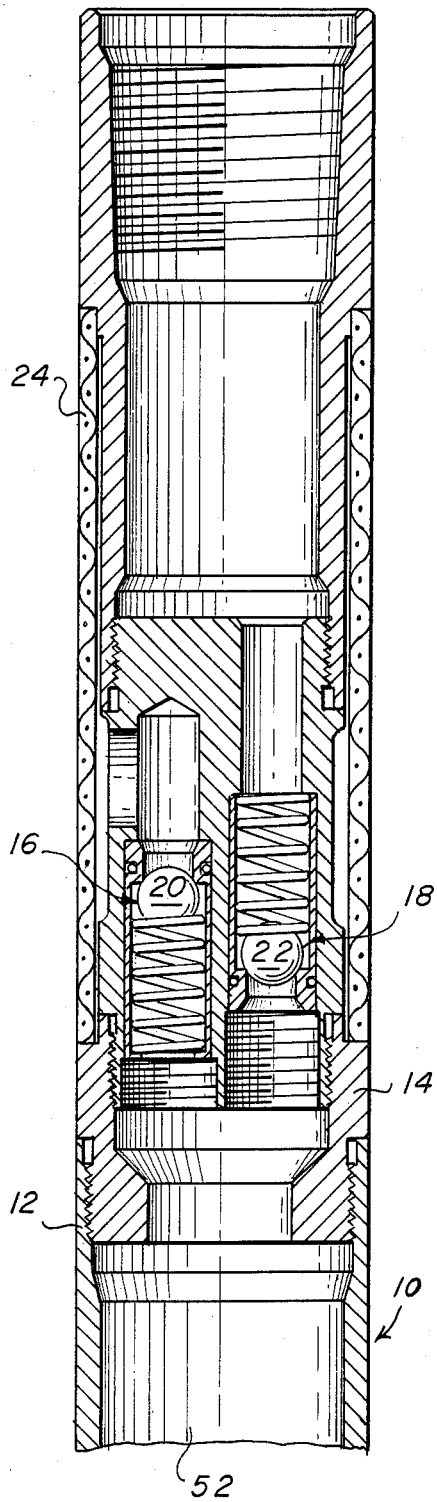
FIGS. 1, 2 and 3 are side elevation views in section of the upper, middle and lower portions of the pump respectively.
Figure 2:
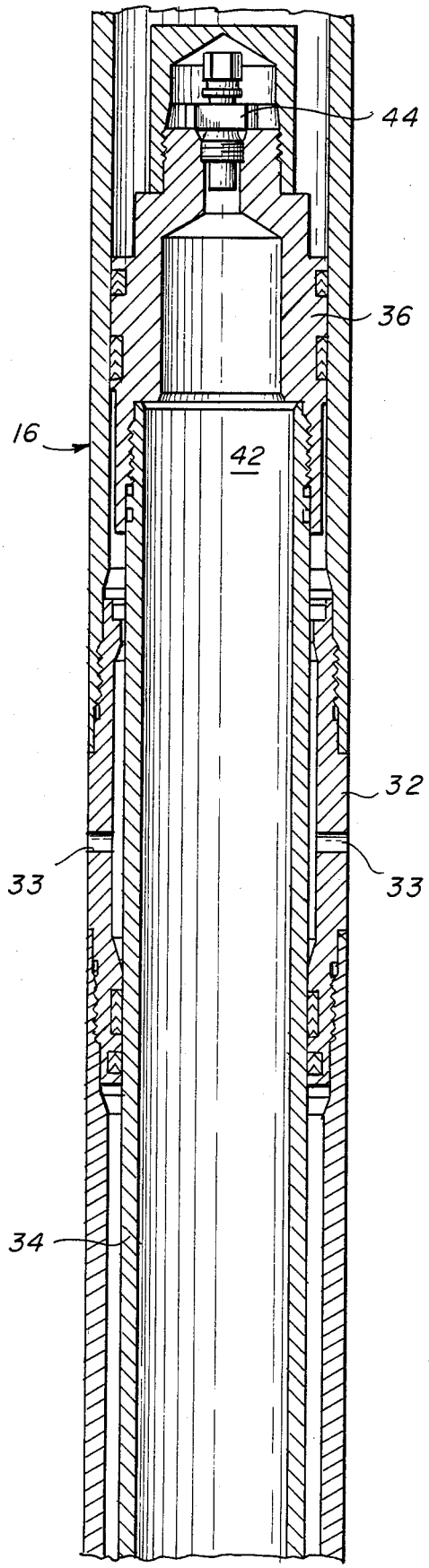
Figure 3:
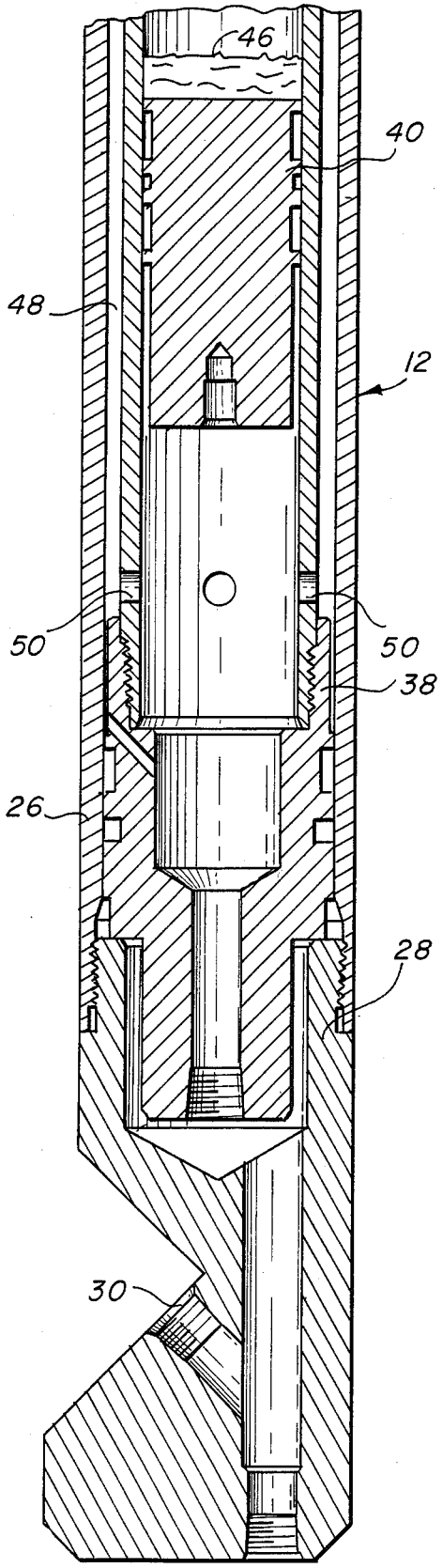

The cylinder of the pump generally indicated by the reference number 10, includes an upper section 12 closed by a head 14 carrying intake and discharge valves 16 and 18 respectively. The valve members 20 and 22 are preferably formed of ceramic material in order to stand up to the corrosive and abrasive environment of the well. The intake valve 16 communicates with the well fluid through a screen or strainer 24 mounted on the cylinder head 14. The cylinder includes a bottom section 26 closed by a bottom head 28 having an inlet port 30 for the working fluid which is supplied from the surface by a separate line not shown.

Within the cylinder there is a reciprocating piston assembly which includes a hollow piston 34 of somewhat lesser outside diameter than the inside diameter of the cylinder and closed at its upper and lower ends by head members 36 and 38 respectively. The cylinder also includes a central portion 32 having seals at opposite ends in sliding engagement with the piston 34. The member 32 includes ports 33 at its mid section communicating the annular space surrounding the hollow piston to the well.

The hollow piston also houses a free piston 40 which reciprocates within the piston 34 and is normally biased downwardly by means of a compressed gas in the space 42 which is charged into the space through the check valve 44 mounted in the upper head 36. Preferably a layer of oil 46 overlies the upper end of the piston 40 to act as a further seal against leakage of the gas past the piston 40. The annular space 48 between the piston 34 and the lower section 26 of of the cylinder 10 is filled with an incompressible liquid such as a hydraulic oil and this space communicates with the underside of the free piston 40 through ports 50 located at the lower end of the piston 34. With the piston 34 in the position illustrated in the drawing, it is at its lower most point of travel and in moving from its uppermost to its illustrated position the pressure in the pump chamber 52 has been lowered to the point where this chamber is filled with well fluid entering the chamber through the screen 24 and the intake valve 16.

When high pressure working fluid from the surface is then admitted to the bottom of the cylinder through the port 30, the entire piston assembly rises and forces the well fluid from the chamber 52 outwardly through the discharge valve 18 and through a pipe not shown to the surface. As the piston rises in the cylinder, the volume of the annular space 48 between the hollow piston 34 and the lower portion 26 of the cylinder decreases forcing the incompressible fluid out of the space through the openings or ports 50 into the interior of the hollow piston underneath the free piston. This in turn forces the free piston to rise in the hollow piston raising the pressure of the gas in the space 42. When the source of high pressure is disconnected, the pressure of the gas in the space 42 forces the free piston 40 downwardly which in turn forces the incompressible fluid outwardly through the ports 50 and into the annular space 48. This reacts against the annular surface of the head 38 and forces the entire piston assembly back down to the position illustrated in the drawing thus readying the pump for the next cycle.

While a preferred embodiment has been herein shown and described, applicants claim the benefit of a full range of equivalents within the scope of the appended claims.

We claim:

1. A oil well, fluid pressure operated, reciprocating piston pump comprising:

a pump cylinder having intake and discharge valves at its upper end and means affording connection to a source of high pressure working fluid at its lower end;

a hollow piston of lesser diameter than and slidably mounted in said cylinder, closed at opposite ends with heads in sliding sealing engagement with said cylinder;

stationary means in said cylinder surrounding and slidably sealingly engaging said piston between said heads;

a free piston in slidable sealing engagement with the interior of said hollow piston;

a pressurized compressible fluid in said hollow piston between the upper end of said free piston and the upper end of said hollow piston;

ports at the lower end of said hollow piston communicating the interior thereof below said free piston with the annular space between the lower portion of said cylinder and hollow piston;

an incompressible fluid filling the space between the lower end of said free piston and the lower end of said hollow piston and the annular space between said hollow piston and cylinder below said stationary means whereby;

the pressure of said compressible fluid biases said free piston toward the lower end of said hollow cylinder forcing said incompressible fluid through said ports to bias said hollow piston toward the bottom of said cylinder permitting well fluid to fill the upper end of said cylinder through said intake valve, and when high pressure working fluid is admitted to the lower end of said cylinder, said hollow piston is forced upwardly to pump well fluid through said discharge valve while forcing said incompressible fluid into the lower portion of said hollow piston to force said free piston upwardly and raise the pressure of said compressible fluid.

2. A pump as defined by claim 1 in which said stationary means in said cylinder includes spaced upper and lower seals for sliding engagement with said hollow piston and ports communicating the annular space between said hollow piston and cylinder between said seals to the exterior of said cylinder.

* * * * *